US006787044B1

(12) United States Patent
Freeman et al.

(10) Patent No.: US 6,787,044 B1
(45) Date of Patent: Sep. 7, 2004

(54) HIGH FREQUENCY WAVE HEATED PLASMA MASS FILTER

(75) Inventors: Richard L. Freeman, Del Mar, CA (US); Robert L. Miller, San Diego, CA (US); John Gilleland, Rancho Santa Fe, CA (US); Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 44 days.

(21) Appl. No.: 10/385,073

(22) Filed: Mar. 10, 2003

(51) Int. Cl.[7] ..... B03C 1/00

(52) U.S. Cl. ..... 210/695; 210/748; 210/222; 210/243; 209/12.1; 209/227; 209/722; 96/2; 96/3; 95/28

(58) Field of Search ..... 210/695, 748, 210/222, 243; 209/12.1, 227, 722; 96/2, 3; 95/28

(56) References Cited

U.S. PATENT DOCUMENTS

| | | | | |
|---|---|---|---|---|
| 3,722,677 | A | 3/1973 | Lehnert | |
| 4,987,007 | A | 1/1991 | Wagal et al. | |
| 5,225,740 | A | 7/1993 | Ohkawa | |
| 5,250,773 | A | 10/1993 | Lind et al. | |
| 5,560,844 | A | 10/1996 | Boulos et al. | |
| 5,611,947 | A | 3/1997 | Vavruska | |
| 5,681,434 | A | 10/1997 | Eastlund | |
| 6,096,220 | A | 8/2000 | Ohkawa | |
| 6,214,223 | B1 | 4/2001 | Ohkawa | |
| 6,248,240 | B1 | 6/2001 | Ohkawa | |
| 6,304,036 | B1 * | 10/2001 | Freeman et al. | 315/111.51 |
| 6,410,880 | B1 | 6/2002 | Putvinski et al. | |

OTHER PUBLICATIONS

Van Der Plas, An Evaluation of Ceramic Materials for Use in Non–Cooled Low–Flow ICP Torches, pp. 1205–1216, Spectrochemical Acta, vol. 42B, 1987.

Van Der Plas, A Radiatively Cooled Torch for ICP–AES Using 1 1 mi–1 of Argon, Spectrochemical Acta, vol. 39B, 1984.

Fauchais, Thermal Plasmas, IEEE Transactions on Plasma Science, vol. 25, No. 6, Dec. 1997.

Mostaghimi, Analysis of an RF Induction Plasma Torch with a Permeable Ceramic Wall, Canadian Journal of Chemical Engineering, vol. 67, Dec. 1989.

Dundas, Titanium Dioxide Production by Plasma Processing, Chemical Engineering Progress, vol. 66, Oct. 1970.

* cited by examiner

*Primary Examiner*—David A. Reifsnyder
(74) *Attorney, Agent, or Firm*—Nydegger & Associates

(57) ABSTRACT

A material separator includes a chamber and electrode(s) to create a radially oriented electric field in the chamber. Coils are provided to generate a magnetic field in the chamber. The separator further includes a launcher to propagate a high-frequency electromagnetic wave into the chamber to convert the material into a multi-species plasma. With the crossed electric and magnetic fields, low mass ions in the multi-species plasma are placed on small orbit trajectories and exit through the end of the chamber while high mass ions are placed on large orbit trajectories for capture at the wall of the chamber.

22 Claims, 3 Drawing Sheets

HIGH FREQUENCY WAVE HEATED PLASMA MASS FILTER

FIELD OF THE INVENTION

The present invention pertains generally to devices and methods for separating and segregating the constituents of a multi-constituent material. More particularly, the present invention pertains to devices for efficiently initiating and maintaining a multi-species plasma in a chamber and then separating the ions in the multi-species plasma according to their respective mass to charge ratios. The present invention is particularly, but not exclusively, useful as a filter to separate the high mass particles from the low mass particles in a plasma that is initiated and maintained by high frequency wave heating.

BACKGROUND OF THE INVENTION

There are many reasons why it may be desirable to separate or segregate mixed materials from each other. One such application where it may be desirable to separate mixed materials is in the treatment and disposal of hazardous waste. For example, it is well known that of the entire volume of nuclear waste, only a small amount of the waste consists of radionuclides that cause the waste to be radioactive. Thus, if the radionuclides can somehow be segregated from the non-radioactive ingredients of the nuclear waste, the handling and disposal of the radioactive components can be greatly simplified and the associated costs reduced.

Indeed, many different types of devices, which rely on different physical phenomena, have been proposed to separate mixed materials. For example, settling tanks which rely on gravitational forces to remove suspended particles from a solution and thereby segregate the particles are well known and are commonly used in many applications. As another example, centrifuges which rely on centrifugal forces to separate substances of different densities are also well known and widely used. In addition to these more commonly known methods and devices for separating materials from each other, there are also devices which are specifically designed to handle special materials. A plasma centrifuge is an example of such a device.

As is well known, a plasma centrifuge is a device which generates centrifugal forces to separate charged particles in a plasma from each other. For its operation, a plasma centrifuge necessarily establishes a rotational motion for the plasma about a central axis. A plasma centrifuge also relies on the fact that charged particles (ions) in the plasma will collide with each other during this rotation. The result of these collisions is that the relatively high mass ions in the plasma will tend to collect at the periphery of the centrifuge. On the other hand, these collisions will generally exclude the lower mass ions from the peripheral area of the centrifuge. The consequent separation of high mass ions from the relatively lower mass ions during the operation of a plasma centrifuge, however, may not be as complete as is operationally desired, or required.

Apart from a centrifuge operation, it is well known that the orbital motions of charged particles (ions) in a magnetic field, or in crossed electric and magnetic fields, will differ from each other according to their respective mass to charge ratio. Thus, when the probability of ion collision is significantly reduced, the possibility for improved separation of the particles due to their orbital mechanics is increased. For example, U.S. Pat. No. 6,096,220, which issued on Aug. 1, 2000 to Ohkawa, for an invention entitled "Plasma Mass Filter" and which is assigned to the same assignee as the present invention, discloses a device which relies on the different, predictable, orbital motions of charged particles in crossed electric and magnetic fields in a chamber to separate the charged particles from each other. In the filter disclosed in Ohkawa '220, the magnetic field is oriented axially, the electric field is oriented radially and outwardly from the axis, and both the magnetic field and the electric field are substantially uniform both azimuthally and axially. As further disclosed in Ohkawa '220, this configuration of fields causes ions having relatively low mass to charge ratios to be confined inside the chamber during their transit of the chamber. On the other hand, ions having relatively high mass to charge ratios are not so confined. Instead, these larger mass ions are collected inside the chamber before completing their transit through the chamber. The demarcation between high mass particles and low mass particles is a cut-off mass $M_c$ which is established by setting the magnitude of the magnetic field strength, B, the positive voltage along the longitudinal axis, $V_{ctr}$, and the radius of the cylindrical chamber, "a". $M_c$ can then be determined with the expression: $M_c=ea^2(B)^2/8V_{ctr}$.

Generally, for most plasma related applications, energy must be expended to initiate and maintain the plasma. Considerable effort has been made to minimize the energy required to initiate and maintain the plasma. Heretofore, electron cyclotron heating (ECH) processes, wherein an electromagnetic wave is launched into a plasma chamber to initiate and maintain the plasma, have been developed for plasma deposition applications (see for example, *Principles of Plasma Discharges and Materials Processing*, by Lieberman, Wiley Interscience, pgs. 412–415).

The general dispersion relation for a wave propagating in plasma can be written:

$$\mathrm{Tan}^2\theta=-K_{\|}(N^2-K_r)(N^2-K_{|})/((N^2-K_{\|})(K_{\perp}N^2-K_{|}K_r)) \quad [1]$$

where θ is the angle of the wave propagation relative to the magnetic field, B, N is the index of refraction (i.e., $N=ck/\omega$) where c is the speed of light, k is the wave vector, $n_e$ is the electron density, e is the electron charge, and ω is the wave frequency); and for frequencies much greater than ion cyclotron and ion plasma frequencies:

$$K_r=1-\omega_p^2/(\omega(\omega-\omega_c))$$
$$K_{|}=1-\omega_p^2/(\omega(\omega+\omega_c))$$
$$K_{195}=1-\omega_p^2/(\omega^2-\omega_c^2))$$
$$K_{\|}=1-\omega_p^2/\omega^2$$

where $w_c=eB/m_c=1.8\times10^{11}$ B and $w_p^2=ne^2/(\epsilon_0 m_c)=57\ n^{1/2}$ are the electron cyclotron and electron plasma frequencies.

For propagation along the magnetic field, θ=0, the numerator of Eq, [1] must vanish and for propagation at θ=π/2 the denominator must vanish. These solutions give the principal waves. The right-hand polarized wave rotates in synchronism with the electrons when $\omega=\omega_{ce}$ leading to resonant energy absorption. Collisional absorption can also be effective and can be estimated by substituting ω=ω+iv. The physics of high frequency wave propagation and absorption lead to two approaches for heating the plasma 5 mass filter with electron cyclotron waves. The first approach utilizes a resonant wave that is launched along the magnetic field with the magnetic field chosen to decrease away from the launcher and the resonant field is located axially at a point where the heating is desired. The second approach utilizes a wave propagating radially in a cavity perpendicular to the magnetic field, (θ=π/2); this requires a high frequency wave above the electron plasma frequency and relies on collisional absorption. For the case of $\theta=0$, choosing the wave synchronous with the electrons allows Eq. [1] to be written:

$$k^2/k_0^2=1-\omega_p^2/(\omega(\omega-\omega_c)) \quad [2]$$

where $k_0=w/_c$ and for perpendicular propagation, $\theta=\pi/2$, the dispersion relation can be written:

$$k^{2-/}k_0^2=K_1K_r/K_{195} \sim(1-\omega_p^2/\omega^2) \text{ for } \omega>\omega_c. \quad [3]$$

For the case of a wave launched along the magnetic field from one end of the device, $\theta=0$. The dispersion relation shows that for regions where $\omega<\omega_c$, the circularly polarized wave propagates at any plasma density and for regions where $\omega=\omega_c$, the circularly polarized wave is strongly damped. For regions where $\omega=\omega_c$, a resonance zone occurs and ionization and heating of gas/plasma occurs. Furthermore, the placement of the resonance zone within the chamber can be controlled by the proper distribution of the magnetic field within the chamber.

For example, consider a chamber having a magnetic field that diverges from a first end of the chamber where the magnetic field is $B_1$ to the middle of the chamber where the magnetic field is $B_0$, and where $B_1>B_0$. When a circularly polarized wave having a frequency, $\omega$, $$\omega=eB_0/m \quad [4]$$

is launched from the first end toward the middle of the chamber, the circularly polarized wave propagates to the resonance zone. This is because $\omega<\omega_c$ for regions where $B>B_0$. Furthermore, the circularly polarized wave is strongly absorbed at the resonance zone where $B=B_0$ and $\omega=\omega_c$. At the resonance zone, heating and ionization of the plasma occurs because the rotating electric field of the circularly polarized wave matches the gyrating orbits of the plasma electrons. Thus, the electrons receive essentially a static electric field which imparts a large acceleration on the electrons. Collisions between the accelerated electrons and other electrons and ions result in heating.

For an exemplary circularly polarized wave of frequency 2.45 GHz (i.e. a wave in the microwave spectrum), the resonance field is approximately $B_0=0.085$ T. For a plasma density, n, of $10^{18}m^{-3}$ the plasma frequency is $\omega_p=5.7\times10^{10}$/s.

For the case of a wave launched perpendicular to the magnetic field, $\theta=\pi/2$, the frequency has to be chosen high enough to insure wave propagation and the absorption is not resonant, but collisional. Since collisional absorption is generally not strong for conditions of interest, it is important to have the plasma immersed in a high Q cavity in order to get efficient heating. A choice of frequency just above the electron plasma frequency at the desired operating point is a good choice. The electron collision frequency for 1eV electrons is about $\nu\sim2.9\times10^{-11}n$, or about $2.9\times10^7$ for a density n of $10^{18}$ $mr^{-3}$ giving a ratio of $\nu/\omega_p\sim5\times10^{-4}$. An estimate of the damping length from the imaginary part of the wave vector for $\omega>\omega_p>\omega_c$ gives:

$$k_i=(\nu/2c)\omega_p^2)/w^2)/(1-\omega_p^2/w^2)^{1/2}\sim(\nu/2c)(\omega_p^2/\omega_p^2)\sim5\times10^{-20}\ n(\omega_p^2/w^2)m^{-1} \quad [5]$$

Hence, the damping length is of order 100 m, so it is desirable to have the cavity Q high enough to allow on the order of $10^3$ transits of the wave to insure adequate damping.

In light of the above, it is an object of the present invention to provide devices and methods suitable for the purposes of efficiently initiating and maintaining a multi-species plasma in a chamber and then separating the ions in the multi-species plasma according to their respective mass to charge ratios. It is another object of the present invention to provide a heating source for a plasma mass filter in which the location within the plasma of the effective heating zone can be adjusted by varying the magnetic field distribution within the filter. It is still another object of the present invention to provide a heating source for a plasma mass filter that does not require high voltage components inside the plasma chamber that would otherwise be subject to breakdown in poor vacuum conditions. Yet another object of the present invention is to provide devices and methods for separating the constituents of a multiconstituent material which are easy to use, relatively simple to implement, and comparatively cost effective.

SUMMARY OF THE INVENTION

In overview, the present invention is directed to devices and methods for separating and segregating the constituents of a multi-constituent material. In particular, for the operation of the present invention, a multi-species plasma is first created from the multi-constituent material using high frequency wave heating. Once the multi-species plasma is created, crossed electric and magnetic fields are used to separate ions in the plasma having a relatively low mass to charge ratio from ions in the plasma having a relatively high mass to charge ratio.

In greater detail, the device in accordance with the present invention If includes a chamber having a substantially cylindrical wall that extends between a first end of the chamber and a second end of the chamber. The cylindrical wall is centered on a longitudinal axis. Magnetic coils are selectively arranged on the outside of the chamber wall and are activated to generate a magnetic field inside the chamber that is directed substantially along the longitudinal axis. In a first embodiment, a magnetic field is established in the chamber that diverges from a magnitude $B_1$ at the first end of the chamber to a magnitude $B_0$ at a zone between the first end and the second end of the chamber, with $B_1$ being greater than $B_0$ ($B_1>B_0$). From the zone where the magnitude is approximately $B_0$, the magnetic field can converge to the second end where the magnetic field has a magnitude $B_2$, with $B_2$ being greater than $B_0$ ($B_2>B_0$), and accordingly ($B_1>B_0<B_2$). In one implementation, the magnetic field has substantially the same magnitude at both the first and second ends of the chamber ($B_1=B_2$). With this cooperation of structure, the magnetic field decreases in magnitude from the first end of the chamber to the zone, while also decreasing in magnitude from the second end of the chamber to the zone. Importantly for this embodiment, a zone having a magnetic field strength of magnitude of $B_0$ is created in the chamber between the first and second end of the chamber wall.

Continuing with the first embodiment, one or more launchers are provided at the end(s) of the chamber to launch circularly polarized electromagnetic wave(s) into the chamber in a direction substantially parallel to the longitudinal axis. For the present invention, the circularly polarized electromagnetic wave(s) are created having a frequency $\omega$, where $\omega=eB_0/m$ and e/m is the electron charge/mass ratio ($e/m=1.8\times10^{11}$ coul/kg). Furthermore, the rotation direction of the E vector of each circularly polarized wave is chosen to coincide with the rotation direction of the electron orbits in the magnetic field. In accordance with the dispersion relationship described above, the circularly polarized electromagnetic wave(s) of frequency $\omega$, are able to propagate from the chamber end to the zone where the magnetic field is approximately $B_0$.

When a feed, which can be any mixture having both high mass and low mass constituents, is introduced into the chamber it will be subjected to ECH. Specifically, at the zone where the magnetic field is approximately $B_0$ (i.e. the resonance zone), electrons in the zone are accelerated by the circularly polarized electromagnetic waves. The accelerated electrons then collide with neutrals, ions and other electrons from the feed and the collisions result in the ionization of neutrals and the heating of the electrons. The ionization and heating at the resonance zone initiates and maintains a multi-species plasma having ions of relatively high mass to charge ratio ($M_1$) and ions of relatively low mass to charge ratio ($M_2$) in the chamber.

The device further includes one or more electrodes for creating an electric field that is radially oriented within the chamber. Specifically, the electrode(s) establish a positive voltage ($V_{ctr}$) along the longitudinal axis and a substantially zero potential at the wall of the chamber. With the crossed electric and magnetic fields, ions having a relatively low mass to charge ratio ($M_2$) generated at the resonance zone are confined inside the chamber and transit through the chamber exiting at one of the chamber ends. On the other hand, ions generated at the resonance zone having a relatively high mass to charge ratio ($M_1$) are not so confined. Instead, these larger mass ions strike a high mass ion collector mounted on the inside of the wall near the resonance zone before completing their transit through the chamber. Specifically, for a high mass ion collector that is at a distance "$a_c$" from the longitudinal axis, ions having a mass ($M_1$) that is greater than a cut-off mass, $M_c$ ($M_1>M_c$) will be collected at the wall near the resonance zone, where $$M_c=ea_c^2(B_c)^2/8V_{ctr}$$

wherein "e" is the ion charge and $B_c$ is the magnetic field at the ends of the high mass ion collector.

In another embodiment of the present invention, a radial electric field is generated in a chamber as described above. Also, coils are provided to generate an axially aligned, uniform magnetic field having magnetic field strength, $B_0$, in the chamber. In this embodiment, a high frequency, polarized electromagnetic wave is launched into the chamber along a substantially radial path to initiate and maintain a plasma in the chamber via collisional absorption.

A pair of spaced apart reflectors are positioned to surround the plasma and establish a high Q cavity therebetween. With this cooperation of structure, the electromagnetic wave can be launched into the chamber for travel back and forth between the reflectors. Each time the wave travels between reflectors, it interacts with the plasma, heating the plasma via collisional absorption. Once generated, the plasma is separated in the crossed electric and magnetic fields as described above.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
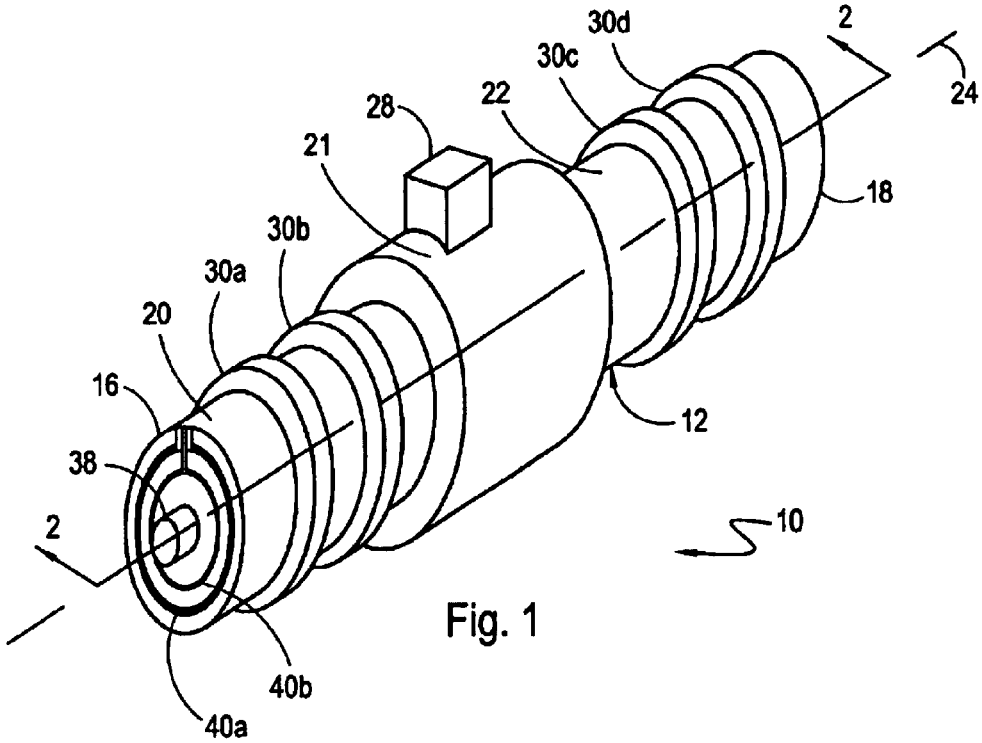
FIG. 1 is a simplified, perspective view of a plasma mass filter wherein the plasma is initiated and maintained using electron cyclotron heating.

Referring initially to FIG. 1, a plasma mass filter for separating and segregating the constituents of a multi-constituent material is shown and generally designated 10. As shown, the filter 10 includes an enclosing wall 12 that extends from a first end 16 to a second end 18. As further shown, the wall 12 is preferably constructed of three cylindrical portions 20, 21 and 22 that are all centered on a common axis 24. With cross reference to FIGS. 1 and 2, it can be seen that the wall 12 surrounds a chamber 25. In accordance with the present invention, a material 26 is radially introduced (in the direction of arrow 27) into the chamber 25 of the filter 10 using injector 28 for conversion into a multi-species plasma. As contemplated for the present invention, the material 26 can be any of a wide variety of mixtures to include: a chemical mixture, a mixture of isotopes, a mixture containing matter that is highly radioactive or any other mixture requiring separation.

Figure 2:
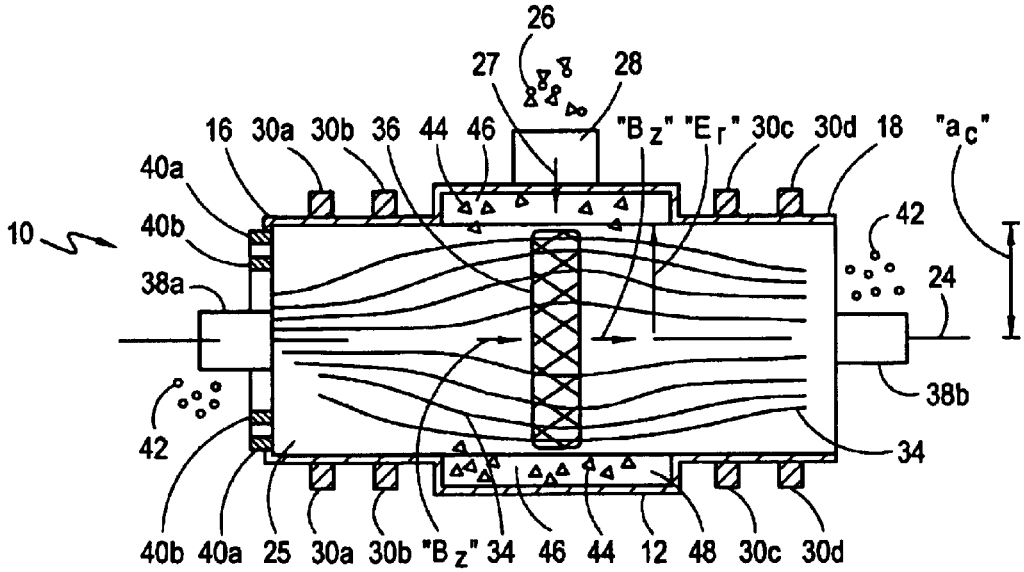
FIG. 2 is a sectional view of the plasma mass filter as seen along line 2—2 in FIG. 1.

Continuing now with cross reference to FIGS. 1 and 2, it can be seen that coils 30*a–d* are positioned on the outside of the wall 12 to generate a magnetic field in the chamber 25. Exemplary field lines 34 show the resulting magnetic field which is directed substantially along the longitudinal axis 24 in the chamber 25. For use in the filter 10, a magnetic field is established in the chamber 25 that diverges from a magnitude $B_1$ at the first end 16 of the chamber 25 to a magnitude $B_0$ at a zone 36 that is located between the first end 16 and the second end 18 of the chamber 25, with $B_1$ being greater than $B_0$ ($B_1>B_0$). From the zone 36 where the magnitude of the magnetic field is approximately $B_0$, the magnetic field converges to the second end 18 of the chamber 25 where the magnetic field has a magnitude $B_2$, with $B_2$ being greater than $B_0$ ($B_2>B_0$). In one implementation of the filter 10, the magnetic field has substantially the same magnitude at both the first end 16 and the second end 18 of the chamber 25 ($B_1=B_2$). With this cooperation of structure, the magnetic field decreases in magnitude from the first end 16 of the chamber 25 to the zone 36, while also decreasing in magnitude from the second end 18 of the chamber 25 to the zone 36. Importantly, the zone 36 has a magnetic field strength of magnitude of $B_0$. Although exemplary coils 30*a–d* are shown for creating the magnetic field distribution described above and shown in FIG. 2, it is to be appreciated that other devices and methods known in the pertinent art for establishing converging and diverging magnetic fields can be used in the present invention.

Referring still to both FIGS. 1 and 2, it can be seen that the filter 10 includes a launcher 38*a* positioned at the first end 16, and a launcher 38*b* positioned at the second end 18. For use in the filter 10, each launcher 38*a,b* is configured to launch a circularly polarized electromagnetic wave into the chamber 25 in a direction that is substantially parallel to the longitudinal axis 24. The circularly polarized electromagnetic waves can be established using an antenna, a waveguide or any other technique known in the pertinent art.

Importantly, for use in the filter 10, the circularly polarized electromagnetic waves are created having a frequency ω, wherein $\omega = eB_0/m$ and e/m is the electron charge/mass ratio. Furthermore, the rotation direction of the E vector of the circularly polarized wave is chosen to coincide with the rotation direction of the electron orbits in the magnetic field. In accordance with the dispersion relationship described in the background section above, the circularly polarized electromagnetic wave of frequency ω, is able to propagate through sections of the chamber 25 where the strength of the magnetic field exceeds $B_0$ Thus, because the strength of the magnetic field exceeds $B_0$ between the first end 16 and the zone 36, the circularly polarized electromagnetic wave of frequency ω generated by the launcher 38*a* is able to propagate to the zone 36 where the magnetic field is approximately $B_0$. Similarly, because the strength of the magnetic field exceeds $B_0$ between the second end 18 and the zone 36, the circularly polarized electromagnetic wave of frequency ω generated by the launcher 38*b* is able to propagate to the zone 36 where the magnetic field is approximately $B_0$.

At the zone 36, where the magnetic field is approximately $B_0$ (i.e. the resonance zone), the circularly polarized electromagnetic waves interact with free electrons, accelerating the free electrons. It is to be appreciated that the accelerated electrons collide with neutrals, ions and other electrons and the collisions result in the ionization of neutrals and the heating of the electrons. This ionization and heating at the zone 36 is capable of initiating and maintaining a plasma in the chamber 25. Thus, material 26 that is fed into the zone 36 of chamber 25 will be converted into a multi-species plasma having ions of relatively high mass to charge ratio ($M_1$) and ions of relatively low mass to charge ratio ($M_2$).

Once the material 26 is converted into a multi-species plasma, the ions of relatively high mass to charge ratio ($M_1$) can be separated and segregated from the ions of relatively low mass to charge ratio ($M_2$). For ion separation, the filter 10 includes electrodes 40*a*, b to create an electric field, $E_r$, that is radially oriented within the chamber 25. As shown, the electrodes 40*a, b* can consist of a plurality of circular rings that are concentrically centered on the longitudinal axis 24 and located at the first end 16. For use in the filter 10, the electrodes 40*a*, b establish a positive voltage ($V_{ctr}$) along the longitudinal axis 24 and a substantially zero potential at the wall 12.

In the operation of the plasma mass filter 10, the chamber 25 is first evacuated. For some applications, a discharge gas is first introduced into chamber 25 to initiate a plasma discharge upon energizing the coils 30*a–d* and the launchers 38*a, b*. In other applications, the material 26 can be introduced directly into the chamber 25 to initiate a plasma discharge upon energizing the coils 30*a–d* and the launchers 38*a, b*. In either case, once a plasma discharge is initiated, material 26 is radially introduced into the chamber 25 using injector 28. Preferably, the material 26 is radially injected into the zone 36 for conversion into ions. It is contemplated for the filter 10 that the material 26 can be fed into the chamber 25 continuously or in batches. Once inside the chamber 25, the material 26 is converted into a multi-species plasma via electron heating by the circularly polarized electromagnetic wave that is generated by the launchers 38*a,b*.

In response to the crossed electric and magnetic fields in the chamber 25, ions in the multi-species plasma having relatively low mass to charge ratios (i.e. low mass ions 42) are placed on small radius, helical trajectories about the longitudinal axis 24. As such, the low mass ions 42 are confined inside the chamber 25 during their transit of the chamber 25 and exit through the ends 16, 18 of the chamber 25, as shown. On the other hand, ions having relatively high mass to charge ratios (high mass ions 44) are placed on large radius, helical trajectories about the longitudinal axis 24, and thus, are not so confined. These high mass ions 44 strike and are captured by a high mass ion collector 46 mounted on the inside of the wall 12 before completing their transit through the chamber 25.

Specifically, for a high mass ion collector 46 that is at a distance "$a_c$" from the longitudinal axis, ions generated in the zone 36 having a mass ($M_1$) that is greater than a cut-off mass, $M_c$ ($M_1 > M_c$) will be collected at the high mass ion collector 46 where $$M_2 = ea_c^2(B_c)^2/8V_{ctr}$$

wherein "e" is the ion charge and $B_c$ is the magnetic field at the end 48 of the high mass ion collector 46. Ions generated in the zone 36 having a mass ($M_2$) that is less than a cut-off mass, $M_c$ ($M_2 < M_c$) will transit through the chamber 25 and exit the chamber 25 through the ends 16, 18 of the chamber 25. During separation of the multi-species plasma in the chamber 25, additional material 26 can be fed into the chamber 25 for separation. As indicated above, the circularly polarized electromagnetic waves will maintain the plasma in the chamber 25 via electron heating.

After the plasma is initiated and maintained by the circularly polarized electromagnetic wave, the circularly polarized electromagnetic wave can be turned off and a helicon wave can be launched into the chamber 25 to maintain the plasma. Use of the helicon wave can allow for higher plasma densities to be obtained in some applications. A suitable system and method for creating a helicon wave for use with the present invention is disclosed in application Ser. No. 09/634,926, filed Aug. 8, 2000, entitled "System and Method for Initiating Plasma Production" by Freeman et al., now issued as U.S. Pat. No. 6,304,036 B1 which is assigned to the same assignee as the present invention. Once the helicon wave is used in place of the circularly polarized electromagnetic wave, a diverging/converging magnetic field is no longer necessary. As such, the coils 30*a–d* can be adjusted to create a magnetic field that is uniform both axially and azimuthally.

Figure 3:
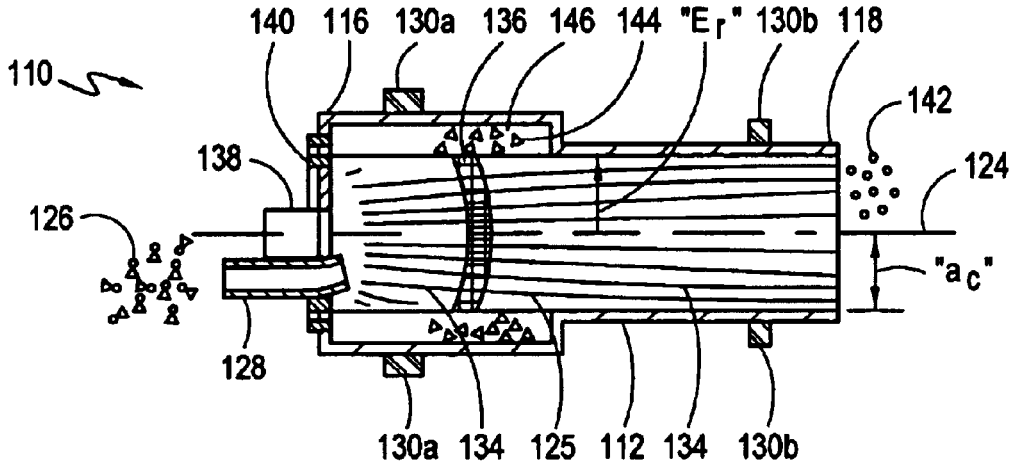
FIG. 3 is a sectional view as in FIG. 2 of another embodiment of a plasma mass filter wherein the plasma is initiated and maintained using electron cyclotron heating.

Referring now to FIG. 3, another embodiment of a plasma mass filter is shown and generally designated 110. As shown, in this embodiment the filter 110 includes an enclosing wall 112 that extends from a first end 116 to a second end 118 and defines an axis 124. It can also be seen that the wall 112 surrounds a chamber 125. For this embodiment, the material 126 is fed into the chamber 125 through a port 128 for conversion into a multi-species plasma.

Continuing now with FIG. 3, it can be seen that coils 130*a, b* are positioned on the outside of the wall 112 to generate a magnetic field in the chamber 125. Exemplary field lines 134 show the resulting magnetic field which is directed substantially along the axis 124 in the chamber 125. For use in the filter 110, the magnetic field established in the chamber 125 diverges from a magnitude $B_1$ at the first end 116 of the chamber 125 to a magnitude $B_0$ at a zone 136 that is located between the first end 116 and the second end 118 of the chamber 125, with $B_1$ being greater than $B_0$ ($B_1 > B_0$). Between the zone 136 where the magnitude of the magnetic field is approximately $B_0$ and the second end 118 of the chamber 125, the magnetic field is substantially uniform in magnitude, as shown. Importantly, the zone 136 has a magnetic field strength of magnitude of $B_0$.

Referring still to FIG. 3, it can be seen that the filter 110 includes a single launcher 138 positioned at the first end 116 to launch a circularly polarized electromagnetic wave into the chamber 125 in a direction that is substantially parallel to the longitudinal axis 124. The circularly polarized electromagnetic wave is created having a frequency ω, wherein $\omega = eB_0/m$ and e/m is the electron charge/mass ratio. Furthermore, the rotation direction of the E vector of the circularly polarized wave is chosen to coincide with the rotation direction of the electron orbits in the magnetic field. In accordance with the dispersion relationship described in the background section above, the circularly polarized electromagnetic wave of frequency ω, is able to propagate through the chamber 125 where the strength of the magnetic field exceeds $B_0$ Thus, because the strength of the magnetic field exceeds $B_0$ between the first end 116 and the zone 136, the circularly polarized electromagnetic wave of frequency w generated by the launcher 138 is able to propagate to the zone 136 where the magnetic field is approximately $B_0$.

At the zone 136, where the magnetic field is approximately $B_0$ (i.e. the resonance zone), the circularly polarized electromagnetic waves interact with free electrons, accelerating the free electrons. It is to be appreciated that the accelerated electrons collide with neutrals, ions and other electrons and the collisions result in the ionization of neutrals and the heating of the electrons. This ionization and heating at the zone 136 is capable of initiating and maintaining a plasma in the chamber 125. Thus, material 126 that is fed into the chamber 125 will be converted into a multi-species plasma having ions of relatively high mass to charge ratio ($M_1$) and ions of relatively low mass to charge ratio ($M_2$).

Once the material 126 is converted into a multi-species plasma, the ions of relatively high mass to charge ratio ($M_1$) can be separated and segregated from the ions of relatively low mass to charge ratio ($M_2$). For ion separation, the filter 110 includes electrodes 140 for creating an electric field, $E_r$, that is radially oriented within the chamber 125. As shown, the electrodes 140 can consist of a plurality of circular rings that are concentrically centered on the longitudinal axis 124 and located at the first end 116. For the filter 110, the electrodes 140 establish a positive voltage ($V_{ctr}$) along the longitudinal axis 124 and a substantially zero potential at the wall 112.

In response to the crossed electric and magnetic fields in the chamber 125, ions in the multi-species plasma having relatively low mass to charge ratios (i.e. low mass ions 142) are placed on small radius, helical trajectories about the longitudinal axis 124. As such, the low mass ions 142 are confined inside the chamber 125 during their transit of the chamber 125 and exit through the second end 118 of the chamber 125, as shown. On the other hand, ions having relatively high mass to charge ratios (high mass ions 144) are placed on large radius, helical trajectories about the longitudinal axis 124, and thus, are not so confined. These high mass ions 144 strike and are captured by a high mass ion collector 146 mounted on the inside of the wall 112 before completing their transit through the chamber 125.

Figure 4:
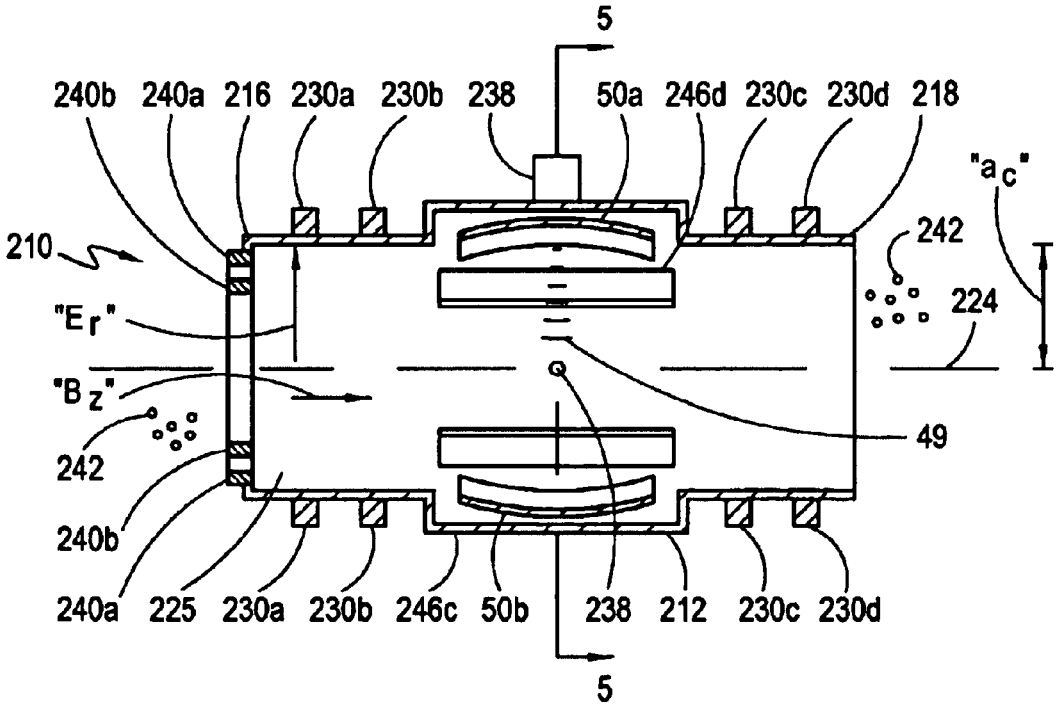
FIG. 4 is a sectional view as in FIG. 2 of another embodiment of a plasma mass filter wherein the plasma is initiated and maintained by collisional absorption using high frequency waves.
Figure 5:
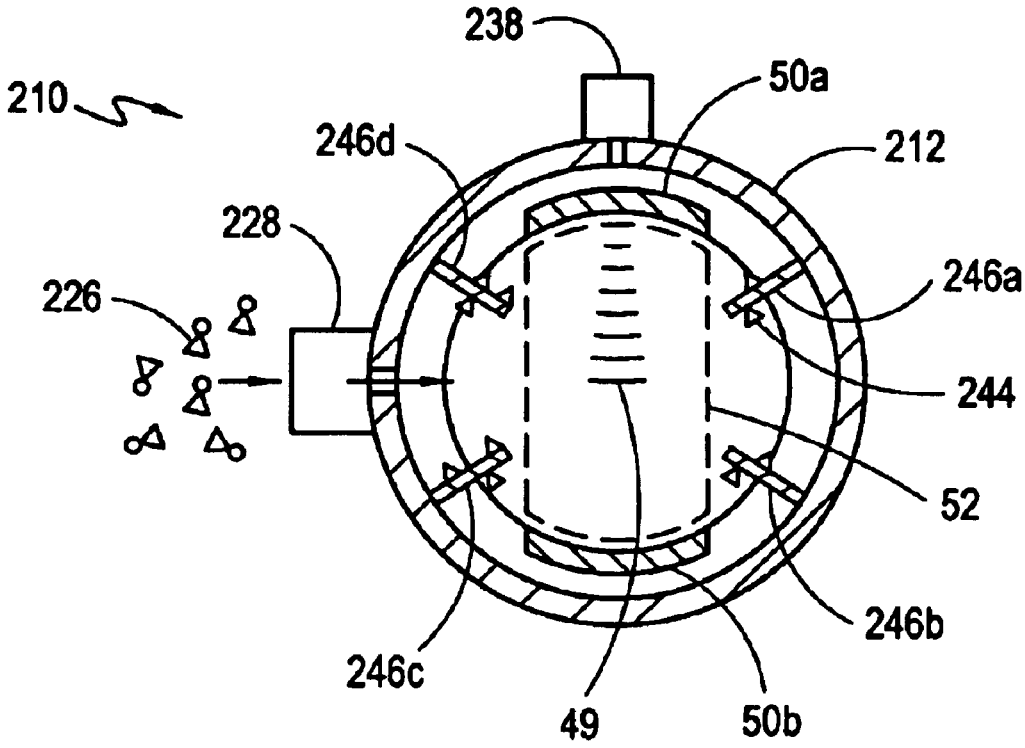
FIG. 5 is a sectional view of the plasma mass filter shown in FIG. 4 as would be seen along line 5—5 in FIG. 4.

Referring now with cross reference to FIGS. 4 and 5, another embodiment of a plasma mass filter is shown and generally designated 210. As shown, in this embodiment the filter 210 includes an enclosing wall 212 that extends from a first end 216 to a second end 218 and defines an axis 224. It can also be seen that the wall 212 surrounds a chamber 225. For this embodiment, injector 228 is provided to feed the material 226 into the chamber 225 along a radial path for conversion into a multi-species plasma.

Continuing now with FIGS. 4 and 5, it can be seen that coils 230*a–d* are positioned on the outside of the wall 212 to generate a magnetic field in the chamber 225. For use in the filter 210, an axially aligned magnetic field can be established in the chamber 225 having a substantially uniform magnetic field strength $B_0$. It can be seen that the filter 210 includes a launcher 238 that is positioned midway between the first end 216 and second end 218 to launch a high frequency, polarized electromagnetic wave 49 into the chamber 225 along a substantially radial path. In one implementation, the electromagnetic wave 49 launched into the chamber 225 has a frequency slightly above the electron plasma frequency at the desired operating point.

As further shown, the filter 210 includes a pair of spaced apart reflectors 50*a,b* (e.g. mirrors) that are positioned to surround the plasma and establish a high Q cavity 52 therebetween. With this cooperation of structure, the electromagnetic wave 49 can be launched into the chamber 225 for travel back and forth between the reflectors 50*a,b*. Each time the wave 49 travels between the reflectors 50*a,b*, it interacts with material 226 and plasma in the cavity 52, heating the material 226 and plasma via collisional absorption. This heat in turn can be used to initiate and maintain a plasma in the chamber 225.

Thus, material 226 that is fed into the chamber 225 will be converted into a multi-species plasma having ions of relatively high mass to charge ratio ($M_1$) and ions of relatively low mass to charge ratio ($M_2$). Once the material 226 is converted into a multi-species plasma, the ions of relatively high mass to charge ratio ($M_1$) can be separated and segregated from the ions of relatively low mass to charge ratio ($M_2$). For ion separation, the filter 210 includes electrodes 240*a,b* (see FIG. 4) for creating an electric field, $E_r$, that is radially oriented within the chamber 225. As shown, the electrodes 240 can consist of a plurality of circular rings that are concentrically centered on the longitudinal axis 224 and located at the first end 216. For the filter 210, the electrodes 240 establish a positive voltage ($V_{ctr}$) along the longitudinal axis 224 and a substantially zero potential at the wall 212.

In response to the crossed electric and magnetic fields in the chamber 225, ions in the multi-species plasma having relatively low mass to charge ratios (i.e. low mass ions 242) are placed on small radius, helical trajectories about the longitudinal axis 224. As such, the low mass ions 242 are confined inside the chamber 225 during their transit of the chamber 225 and exit through the first end 216 and second end 218 of the chamber 225, as shown. On the other hand, ions having relatively high mass to charge ratios (high mass ions 244) are placed on large radius, helical trajectories about the longitudinal axis 224, and thus, are not so confined. These high mass ions 244 strike and are captured by high mass ion collectors 246*a–d* that are mounted on the inside of the wall 212 before completing their transit through the chamber 225.

While the particular High Frequency Wave Heated Plasma Mass Filter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A plasma mass filter which comprises:

a chamber having a substantially cylindrical wall, said chamber defining a longitudinal axis;

a means for generating a magnetic field in said chamber with said magnetic field being directed along said axis;

a means for generating an electric field in said chamber with said electric field being crossed with said magnetic field;

a means for launching an electromagnetic wave into said chamber to create an ionization zone therein, a means for directing a feed into said ionization zone for heating thereof by said electromagnetic wave to create a multi-species plasma having ions of relatively high mass ($M_1$) and ions of relatively low mass ($M_2$); and a collector mounted on said wall to collect said ions of relatively high mass ($M_1$) ejected from said multi-species plasma by said crossed electric and magnetic fields in said chamber.

2. A filter as recited in claim 1 wherein said chamber extends between a first end and a second end, said magnetic field has a magnitude $B_1$ at said first end and a magnitude $B_0$ in said chamber between said first end and said second end, wherein $B_1$ is greater than $B_0$ ($B_1>B_0$), and wherein said launching means is mounted at said first end of said chamber and said electromagnetic wave has a frequency ω, wherein $\omega=eB_0/m$ and e/m is the electron charge/mass ratio.

3. A filter as recited in claim 2 wherein said electromagnetic wave is circularly polarized and the E vector of said circularly polarized electromagnetic wave rotates in the same direction as the electron orbits in said magnetic field.

4. A filter as recited in claim 2 wherein said electromagnetic wave is launched into said chamber in a direction substantially parallel to said axis.

5. A filter as recited in claim 1 wherein said feed is injected radially into said chamber.

6. A filter as recited in claim 1 wherein said electric field is radially oriented and has a positive voltage ($V_{ctr}$) along said axis and a substantially zero potential on said wall.

7. A filter as recited in claim 6 wherein said collector is at a distance "$a_c$" from said longitudinal axis at said ionization zone and extends to a collector end wherein the magnetic field has a magnitude $B_c$, and further wherein "e" is the charge of a particle and said ions of relatively high mass ($M_1$) are greater than a cut-off mass M where $$M=ea_c^2(B_c)^2/8V_{ctr}.$$

8. A filter as recited in claim 1 further comprising a source for generating a helicon wave in said chamber to maintain said multi-species plasma.

9. A filter as recited in claim 1 further comprising a means for converging said magnetic field in said chamber between said ionization zone and said second end with said magnetic field having a magnitude $B_2$ at said second end wherein $B_2$ is greater than $B_0$ ($B_2>B_0$) and said filter further comprises a means mounted at said second end of said chamber for launching an electromagnetic wave into said chamber.

10. A filter as recited in claim 1 wherein said launching means is positioned to launch said electromagnetic wave into the chamber along a substantially radial path.

11. A filter as recited in claim 10 further comprising a first reflector and a second reflector, said first reflector spaced from said second reflector to create a cavity therebetween with said launching means positioned to launch said electromagnetic wave into said cavity for reflection from said first reflector to said second reflector.

12. A plasma mass filter for heating and ionizing a chemical mixture to produce a multi-species plasma, and for separating said multi-species plasma into ions of relatively high mass to charge ratio and ions of relatively low mass to charge ratio, said plasma mass filter comprising:

a wall surrounding a volume and defining a longitudinal axis passing through said volume, said wall having a first end and a second end;

a means for generating a magnetic field in said volume and having a magnitude $B_1$ at said first end of said wall, a magnitude $B_0$ at a point within said volume between said first end and said second end, wherein $B_1$ is greater than $B_0$ ($B_1>B_0$), and a magnitude $B_2$ at said second end of said wall, wherein $B_2$ is greater than $B_0$ ($B_2>B_0$);

a means for launching a circularly polarized electromagnetic wave into said volume to create an ionization zone therein, said electromagnetic wave having a frequency ω, wherein $\omega=eB_0/m$ and e/m is the electron charge/mass ratio; and a means for generating an electric field in said chamber with said electric field being crossed with said magnetic field to place ions of relatively high mass to charge ratio on trajectories toward said wall for collection at said wall and to place ions of relatively low mass to charge ratio on trajectories towards said second end for collection at said second end.

13. A filter as recited in claim 12 wherein said means for launching a circularly polarized electromagnetic wave into said volume comprises an antenna.

14. A filter as recited in claim 12 wherein said means for launching a circularly polarized electromagnetic wave into said volume comprises a cylindrical waveguide.

15. A filter as recited in claim 12 wherein said electric field has a positive voltage ($V_{ctr}$) along said axis and a substantially zero potential on said wall.

16. A filter as recited in claim 12 wherein the E vector of said circularly polarized electromagnetic wave rotates in the same direction as the electron orbits in said magnetic field.

17. A method for separating a chemical mixture into constituents, said method comprising the steps of:

providing a chamber having a substantially cylindrical wall extending between a first end and a second end, said chamber defining a longitudinal axis;

introducing a gas into said chamber;

generating a magnetic field in said chamber with said magnetic field being directed along said axis and diverging from a magnitude $B_1$ at said first end to a magnitude $B_0$ between said first end and said second end and converging from said magnitude $B_0$ to a magnitude $B_2$ at said second end, wherein $B_1$ is greater than $B_0$ ($B_1>B_0$) and $B_2$ is greater than $B_0$ ($B_2>B_0$);

launching a circularly polarized electromagnetic wave into said chamber to create an ionization zone therein, said electromagnetic wave having a frequency ω, wherein $\omega=eB_0/m$ and e/m is the electron charge/mass ratio;

feeding the chemical mixture into said ionization zone for ionization and heating thereof by said electromagnetic wave to create a multi-species plasma having ions of relatively high mass ($M_1$) and ions of relatively low mass ($M_2$); and generating a radially oriented electric field in said chamber, said electric field and said magnetic field for interaction with said multispecies plasma to eject said high mass particles into said wall and for confining said low mass particles in said chamber during transit therethrough to separate said low mass ions from said high mass ions.

18. A method as recited in claim 17 further comprising the steps of:

interrupting said circularly polarized electromagnetic wave of frequency ω; and launching a helicon wave in said chamber to heat and maintain said multi-species plasma.

19. A method as recited in claim 17 wherein the magnitude $B_1$ at said first end is substantially equal to the magnitude $B_2$ at said second end ($B_1=B_2$).

20. A method as recited in claim 17 wherein said electric field has a positive voltage ($V_{ctr}$) along said axis and a substantially zero potential on said wall.

21. A method as recited in claim 20 further comprising the step of positioning a collector at a distance "$a_c$" from said longitudinal axis to collect said ions of relatively high mass ($M_1$), said collector extending to a collector end wherein the magnetic field has a magnitude $B_c$, and further wherein "e" is the charge of a particle and said ions of relatively high mass ($M_1$) are greater than a cut-off mass M where $$M=ea_c^2(B_c)^2/8V_{ctr}.$$

22. A method as recited in claim 17 wherein the E vector of said circularly polarized electromagnetic wave rotates in the same direction as the electron orbits in said magnetic field.

* * * * *

UNITED STATES PATENT AND TRADEMARK OFFICE

CERTIFICATE OF CORRECTION

PATENT NO. : 6,787,044 B1 
DATED : September 7, 2004
INVENTOR(S) : Richard L. Freeman et al.

It is certified that error appears in the above-identified patent and that said Letters Patent is hereby corrected as shown below:

Column 2,
Line 48, delete "$K_{195} = 1 - \omega_p^2/(\omega^2-\omega_c^2))$" insert -- $K_\perp = 1 - \omega_p^2/(\omega^2-\omega_c^2))$ --
Line 49, delete "$w_c = eB/m_c$" insert -- $\omega_c = eB/m_c$ --
Line 49, delete "$w_p^2 = ne^2/(\varepsilon_0 m_c)$" insert -- $\omega_p^2 = ne^2/(\varepsilon_0 m_c)$ --
Line 59, delete "plasma 5" insert -- plasma --

Column 3,
Line 7, delete "$k_0 = w/_c$" insert -- $k_0 = \omega/_c$ --
Line 10, delete "$k^{2-lk}{}_0{}^2 = K_1K_r/K_{195} \sim (1 - \omega_p^2/\omega^2)$ for $\omega > \omega_c$." insert
-- $k^2/k_0^2 = K_1K_r/K_\perp \sim (1 - \omega_p^2/\omega^2)$ for $\omega > \omega_c$. --
Line 57, delete "$mr^{-3}$" insert -- $m^{-3}$ --
Line 60, "$k_i = (\nu/2c)\omega_p^2/w^2)/(1 - \omega_p^2/w^2)^{1/2} \sim (\nu/2c)(\omega_p^2/\omega^2) \sim 5 \times 10^{-20}{}_n\, (\omega_p^2/w^2)\ m^{-1}$"
insert -- $k_i = (\nu/2c)(\omega_p^2/\omega^2)/(1 - \omega_p^2/\omega^2)^{1/2} \sim (\nu/2c)(\omega_p^2/\omega^2) \sim 5 \times 10^{-20}{}_n\, (\omega_p^2/\omega^2)\ m^{-1}$ --

Column 4,
Line 30, delete "invention If Includes" insert -- invention includes --

Column 7,
Line 11, delete "$B_0$" insert -- $B_{0.}$ --

Column 8,
Line 15, delete "$M_2 = ea_c^2(B_c)^2/8V_{ctr}$" insert -- $M_c = ea_c^2(B_c)^2/8V_{ctr}$ --

Column 9,
Line 6, delete "w" insert -- $\omega$ --
Line 13, delete "$B_0$" insert -- $B_{0.}$ --

Signed and Sealed this

Seventh Day of December, 2004

JON W. DUDAS
*Director of the United States Patent and Trademark Office*